United States Patent [19]

Silva

[11] 4,103,980

[45] Aug. 1, 1978

[54] WALL-MOUNTED DIRECTORY

[76] Inventor: Patricia A. Silva, 2215 Aurora Dr., Pittsburgh, Pa. 15237

[21] Appl. No.: 768,766

[22] Filed: Feb. 15, 1977

[51] Int. Cl.[2] ..... A47B 63/00; B42F 17/00

[52] U.S. Cl. ..... 312/185; 312/245; 312/50

[58] Field of Search ..... 312/245, 50, 185, 248, 312/188

[56] References Cited

U.S. PATENT DOCUMENTS

| | | | |
|---|---|---|---|
| 454,265 | 6/1891 | Fezandie | 312/185 |
| 1,170,065 | 2/1916 | Hirschman | 312/248 |
| 1,207,949 | 12/1916 | Long | 312/185 |
| 1,359,990 | 11/1920 | Higdon | 312/185 |
| 1,362,310 | 12/1920 | Hiller et al. | 312/185 |
| 1,381,361 | 6/1921 | Studer | 312/185 |
| 1,453,943 | 5/1923 | Mitchell | 312/248 |
| 2,548,828 | 4/1951 | Syverud | 312/248 |
| 3,027,215 | 3/1962 | Duncan | 312/245 |
| 3,405,716 | 10/1968 | Cafiero et al. | 312/185 |
| 3,767,057 | 10/1973 | Holmes | 312/50 |

*Primary Examiner*—Paul R. Gilliam
*Assistant Examiner*—Victor N. Sakran
*Attorney, Agent, or Firm*—Webb, Burden, Robinson & Webb

[57] ABSTRACT

A wall-mounted enclosure including means, such as cards, providing a convenient telephone directory or the like includes a wall-mounted portion and a desk portion adapted to close the wall-mounted portion. The desk portion contains means, such as rods, for removably mounting the cards.

3 Claims, 3 Drawing Figures

WALL-MOUNTED DIRECTORY

BACKGROUND OF THE INVENTION

This application relates to a wall-mounted directory and particularly to a wall-mounted enclosure adapted for location near a telephone or the like and which contains a plurality of cards which provide a convenient directory of names, addresses, telephone numbers, or any other information which the user desires to place on the cards.

DESCRIPTION OF THE PRIOR ART

Among the many known wall-mounted enclosures are cabinets, shelf units, and the like. Some of these have hingedly mounted doors which are adapted to be opened and closed. In some of these enclosures, the door is hingedly mounted so as to open vertically to provide a shelf-like structure. In none of these prior art units, however, is there any provision for holding a plurality of cards forming a convenient directory nor is there any provision for adding to or subtracting from the number of cards included in the directory.

SUMMARY OF THE INVENTION

I have invented a convenient wall-mounted enclosure which serves as a telephone directory comprising a wall-mounted portion having a front opening which is closed by a desk portion which is hingedly mounted to the wall-mounted portion such that it swings from a first and closed position to a second and open position in which the desk portion extends substantially perpendicularly from a wall upon which the enclosure is mounted. The desk portion includes, preferably, a plurality of rods for supporting and aligning a plurality of removable cards which may carry useful information such as names, addresses, telephone numbers, and any other information which the user may desire to place on the cards.

The enclosure is aesthetically attractive, may be made of wood, plastic or any other substantial material, and is easily wall mounted. The removable cards may be made of heavy or light paper, plastic, or other suitable material; they may be appropriately mounted and aligned on the rods or the like.

A complete understanding and appreciation of the features and advantages of my invention will become apparent from the following description, when taken with the accompanying drawings.

BRIEF DESCRIPTION OF THE PREFERRED EMBODIMENTS OF MY INVENTION

Figure 1:
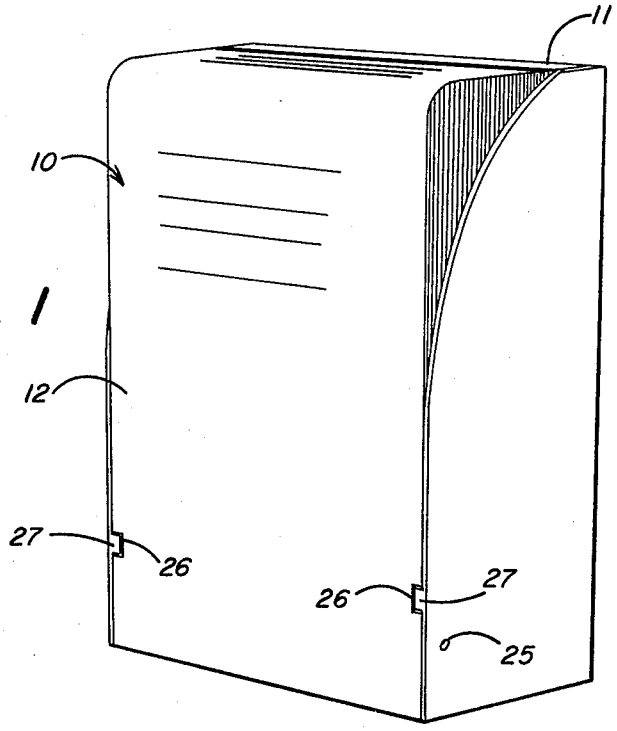
FIG. 1 shows a perspective view of my enclosure with the desk portion in a closed position.

Referring to FIG. 1, an enclosure 10 according to my invention comprises a wall-mounted portion 11 which may be secured by appropriate fasteners to a wall or the like near a telephone (not shown). A desk portion 12 is adapted to be pivotably mounted near the bottom thereof so that it can completely close, in the manner of a cover, against the wall-mounted portion 11 to form a compact enclosure adjacent a wall.

Figure 2:
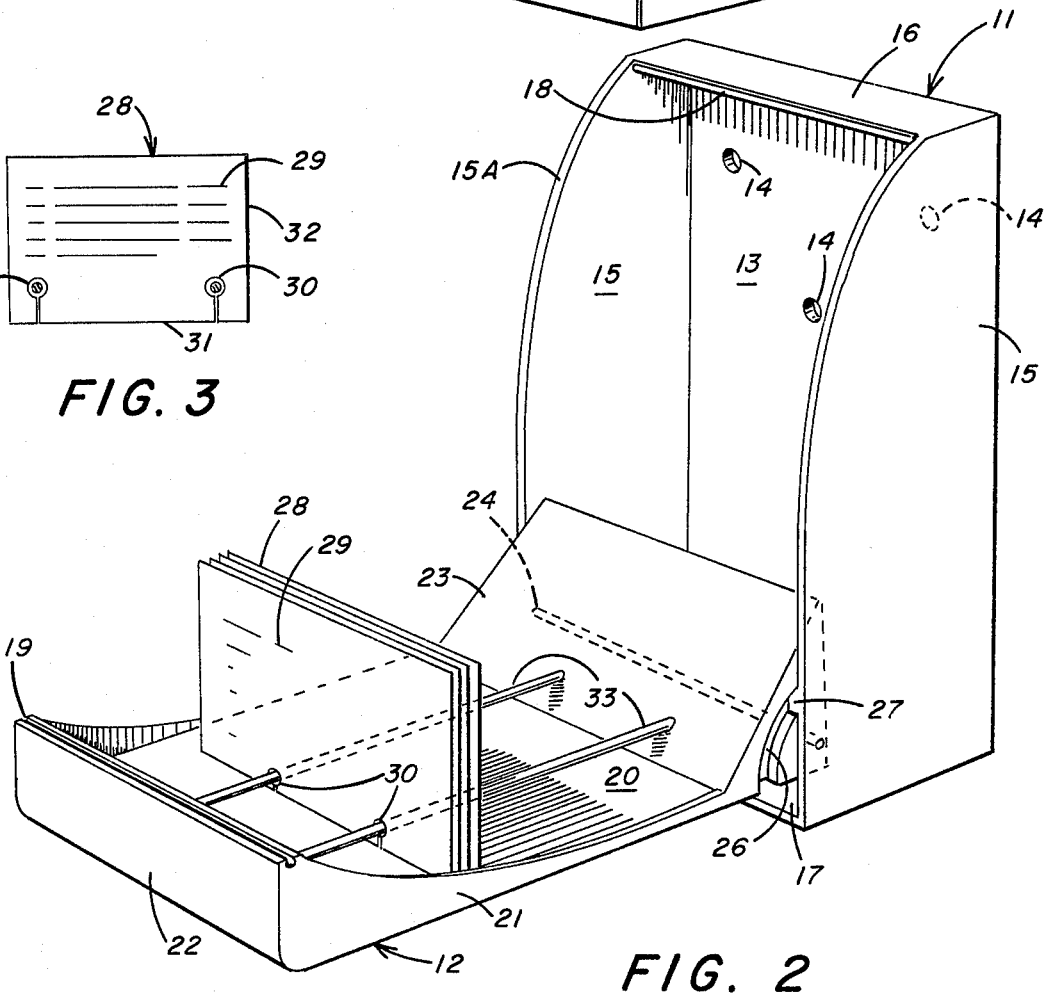
FIG. 2 is a perspective view of my enclosure with the desk portion in an open position in which directory cards are exposed for view.

The wall-mounted portion 11 comprises, as shown particularly in FIG. 2, a back wall 13 having apertures 14 through which fasteners, such as screws, nails or the like, may be placed. There are two side walls 15, top wall 16 and bottom wall 17 which form the wall-mounted portion of the enclosure. The side walls 15 are curved near the upper ends thereof, as shown at 15A. A rib 18 extends across the front edge of the top wall 16 and is adapted for connection with a notch 19 provided in the desk portion 12.

In its open position, the desk portion 12 extends substantially perpendicularly to the back wall 13 which may be fastened to a wall and parallel with bottom wall 17 of the wall-mounted portion 11. The desk portion comprises a rectangular wall 20 having narrow side walls 21 which are adapted to cooperate with the side walls 15 of the wall-mounted portion 11.

The front edge 22 of the desk portion 12 includes the notch 19, heretofore described. The desk portion 12 also preferably includes a solid member 23 having a triangular cross section which serves as a card rest. A rod 24 extends through openings 25 in side walls 15 of the wall-mounted portion and through a longitudinal aperture in the member 23 pivotally securing the desk portion 12 to the wall-mounted portion 11.

A curved groove 26 is formed on each end of the member 23. On the inside of each side wall 15 there is a rib or flange 27 which is adapted to fit into a groove 26. Each groove 26 extends from the wall 20 (See FIG. 1) to allow the flange 27 to pass when the desk portion 12 is completely closed against the wall-mounted portion 11 in a first or closed position and is of sufficient length to permit the desk portion to extend perpendicularly from the wall-mounted portion 11 when the flanges 27 engage the ends of their respective grooves, the ends of the grooves serving as a stop when the desk portion is in a second or open position. The engagement of the flanges 27 with the ends of the curved grooves 26 allows the desk portion to remain in a stable position when open. When the desk portion 12 is pivotally closed against the wall-mounted portion 11, the notch 19 engages the rib 18 to provide a "snap-fit" connection between the two and thus prevents the desk portion 12 from accidentally falling away from the wall-mounted portion 11.

Figure 3:
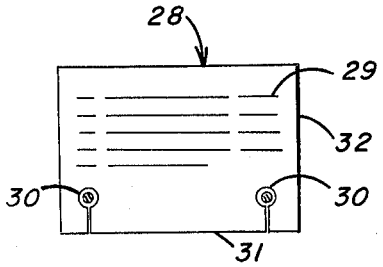
FIG. 3 is a plan view of a directory card useful in my invention.

A plurality of cards 28 are provided in the desk portion 12. The cards serve as a directory, each bearing indicia 29 such as names, addresses, telephone numbers or the like; the cards are thus available for each reference, especially when the enclosure 10 is located adjacent a telephone instrument. The cards are preferably of the type shown in FIGS. 2 and 3 and include two slotted holes 30 adjacent the lower edge 31 of each card and spaced inwardly from the sides 32 thereof. The cards are preferably mounted on parallel rods 33, as shown in FIG. 2. Each rod is secured, at one end, in the front edge 22 of the desk portion 12 and, at the other end, in member 23. It will be obvious to those skilled in the art that more or less than the two rods shown in FIG. 2 may be employed and as few as one rod may be used with equal facility.

Any number of cards 28 may be used, provided there is sufficient room within the enclosure 10 to contain them and to provide visibility to each card since the indicia 29 on each card should be easily read. The form of card 28 provides easy facility for adding or subtracting cards to the directory. In order to remove a card 28 from the directory, it is necessary only to pull on it so that the rods 33 pass through the slots adjacent holes 30, permitting the card to be removed from the directory. To add a card one need only perform the reverse operation.

Moreover, other uses for the enclosure are within my contemplation, but it is my intention that the enclosure be used principally for a directory of the type which I have described utilizing the form of cards disclosed.

Having described preferred embodiments of my invention, it is to be understood that it may be otherwise embodied within the scope of the appended claims.

I claim:

1. An enclosure which is adapted for mounting on a wall and suitable for use as a card directory, said enclosure comprising:

A. a wall-mounted portion and a desk portion, (a) said wall-mounted portion having a back wall, two side walls and two end walls, (b) said desk portion being pivotally mounted on the side walls of said wall-mounted portion at an end thereof and adapted to move from a closed position against the wall-mounted portion to an open position whereby the desk portion extends perpendicularly to the wall-mounted portion, (c) the wall-mounted portion including a laterally extending and forwardly facing rib on an edge of the end wall opposite the end of the side wall to which the desk portion is pivotally mounted, (d) the desk portion including along an edge thereof opposite the end at which the desk portion is pivotally mounted to the side walls of the wall-mounted portion a laterally extending notch for engagement with said rib whereby, when the desk portion is closed against the wall-mounted portion, the rib engages the notch to secure the enclosure, (e) the desk portion also including a member having a triangular cross section forming a card rest and being pivotally mounted on a rod which extends from one side wall to the other of the wall-mounted portion through the card rest, (f) each side wall of the wall-mounted portion having a flange on the opposed inside surfaces adjacent a front edge of the sidewall, (g) said desk portion including a curved groove on each side of the member forming the card rest, each of said grooves having an open end and a closed end forming a stop, the flanges being adapted to fit within said grooves, the extent of travel of the desk portion in an arc toward and away from the wall-mounted portion being limited by the length of the grooves, the flanges engaging the stops formed by the ends of the grooves when the desk portion is in a position substantially perpendicular to the backwall of the wall-mounted portion and closing the open ends of the grooves when the desk portion is in its closed position against the wall-mounted portion, and B. means on the desk portion for removably mounting a plurality of cards bearing indicia providing a directory or the like, said card mounting means comprising at least one rod extending from the front edge of the desk portion on which the notch is located to the other end of the desk portion where at the rod extends into the card rest for holding cards containing an opening through which the rod can extend for supporting the cards so that they are visible when the desk portion is in an open position and so that they are held during and upon closure of the desk portion against the wall-mounted portion.

2. The enclosure set forth in claim 1 and including a plurality of cards mounted on said means and removable therefrom for adding or removing cards to the directory, the size of the cards being such that they are completely contained within the enclosure when the desk portion is closed against the wall-mounted portion.

3. The enclosure set forth in claim 1 wherein the card mounting means comprises a pair of rods, one end of each rod being engaged in the card rest and the opposite end of each rod being engagable in a front wall of the desk portion.

* * * * *